US011852374B2

(12) United States Patent
Li

(10) Patent No.: US 11,852,374 B2
(45) Date of Patent: Dec. 26, 2023

(54) HUMIDIFIER

(71) Applicant: SHENZHEN MIAOXIN TECHNOLOGY CO., LTD, Shenzhen (CN)

(72) Inventor: Zhe Li, Beijing (CN)

(73) Assignee: SHENZHEN MIAOXIN TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 17/571,204

(22) Filed: Jan. 7, 2022

(65) Prior Publication Data

US 2023/0136098 A1 May 4, 2023

(30) Foreign Application Priority Data

Nov. 2, 2021 (CN) ..... 202122663762.8

(51) Int. Cl.

| | |
|---|---|
| ***F24F 6/04*** | (2006.01) |
| *F24F 6/00* | (2006.01) |
| *F24F 11/30* | (2018.01) |
| *F24F 11/88* | (2018.01) |
| *F24F 13/20* | (2006.01) |

(Continued)

(52) U.S. Cl.

CPC ..... *F24F 6/04* (2013.01); *F24F 8/80* (2021.01); *F24F 11/30* (2018.01); *F24F 11/88* (2018.01); *F24F 13/08* (2013.01); *F24F 13/20* (2013.01); *F24F 2006/008* (2013.01); *F24F 2006/046* (2013.01); *F24F 2013/205* (2013.01)

(58) Field of Classification Search

CPC ..... F24F 6/04; F24F 8/80; F24F 11/30; F24F 11/88; F24F 13/08; F24F 13/20; F24F 2006/008; F24F 2006/046; F24F 2013/205

See application file for complete search history.

(56) References Cited

U.S. PATENT DOCUMENTS 1,991,581 A * 2/1935 Shelor ..... F24F 6/04 261/107
3,075,750 A * 1/1963 Goettl ..... F24F 6/04 55/491

(Continued)

FOREIGN PATENT DOCUMENTS

EP 2860464 A1 * 4/2015 ..... F24F 6/043

*Primary Examiner* — Stephen Hobson
(74) *Attorney, Agent, or Firm* — Dragon Sun Law Firm, PC; Nathaniel Perkins

(57) ABSTRACT

The embodiments of the present disclosure disclose humidifier. A specific implementation of the humidifier comprises: a housing and an inclined flow fan assembly fixed in the housing through a connecting plate, wherein the inclined flow fan assembly comprises a fan motor and a fan hub, the inside of the fan hub is further provided with a first annular water retaining portion, the bottom end of the first annular water retaining portion is connected with the fan hub; the inclined flow fan assembly further comprises a second annular water retaining portion arranged between the fan hub and the first annular water retaining portion and fixedly connected with the connecting plate, the bottom end of the second annular water retaining portion is lower than the top ends of the fan hub and the first annular water retaining portion. This implementation improves the safety and water-resisting property of the humidifier.

9 Claims, 4 Drawing Sheets

(51) Int. Cl.
*F24F 8/80* (2021.01)
*F24F 13/08* (2006.01)

(56) References Cited

U.S. PATENT DOCUMENTS 3,497,453 A * 2/1970 Alfred ..... F24F 6/04 210/698
3,917,759 A * 11/1975 Martin ..... F24F 6/04 261/36.1
4,045,523 A * 8/1977 Goettl ..... F28C 1/04 261/106
4,419,300 A * 12/1983 VanNess ..... F28F 21/067 62/304
4,672,820 A * 6/1987 Goettl ..... F28C 3/08 62/304
4,846,266 A * 7/1989 Acker ..... F28D 5/02 261/103
4,933,117 A * 6/1990 Wilson ..... F24F 5/0035 261/106
5,037,586 A * 8/1991 Mehrholz ..... F24F 6/04 261/142
5,061,405 A * 10/1991 Stanek ..... F24F 6/043 261/104
5,483,616 A * 1/1996 Chiu ..... F24F 6/043 392/404
5,529,726 A * 6/1996 Glenn ..... F24F 6/04 261/142
5,783,117 A * 7/1998 Byassee ..... F24F 6/043 261/107
5,971,205 A * 10/1999 Michaels ..... G07F 11/16 221/241
5,975,502 A * 11/1999 Stanek ..... F24F 6/043 261/36.1
5,978,502 A * 11/1999 Ohashi ..... G06V 20/64 348/126
6,149,141 A * 11/2000 Birdsell ..... F24F 6/043 261/106
6,311,958 B1 * 11/2001 Stanek ..... F24F 13/20 261/84
6,427,984 B1 * 8/2002 Mulvaney ..... F24F 6/043 261/107
6,523,810 B2 * 2/2003 Offir ..... F24F 6/043 261/DIG. 65
6,581,917 B2 * 6/2003 Mulvaney ..... F24F 11/88 261/DIG. 65
6,796,550 B2 * 9/2004 Mulvaney ..... F24F 6/043 73/29.02
8,252,079 B2 * 8/2012 Gruhler ..... B01D 45/08 55/491
9,464,817 B2 * 10/2016 Jang ..... F24F 11/0008
9,506,667 B2 * 11/2016 Lee ..... F24F 6/16
9,696,050 B2 * 7/2017 McGarva ..... F24F 11/0008
9,776,144 B1 * 10/2017 Lu ..... F24F 11/0008
10,092,874 B2 * 10/2018 Bae ..... F24F 6/06
11,047,585 B2 * 6/2021 Petersen ..... F28C 3/08
2013/0302156 A1 * 11/2013 Nurzynski ..... F04D 29/30 415/208.1
2015/0330643 A1 * 11/2015 Lee ..... F24F 6/06 210/243
2016/0059175 A1 * 3/2016 Bae ..... B01D 47/16 261/30
2016/0123612 A1 * 5/2016 Lee ..... B01D 39/1615 261/24
2016/0370022 A1 * 12/2016 Jang ..... F24F 6/06
2017/0120181 A1 * 5/2017 Jeon ..... F24F 13/20
2017/0120182 A1 * 5/2017 Kim ..... F24F 11/30
2017/0122582 A1 * 5/2017 Chong ..... B01F 23/21312
2017/0122583 A1 * 5/2017 Lee ..... F24F 13/20
2017/0122584 A1 * 5/2017 Chong ..... B01D 46/10
2017/0122585 A1 * 5/2017 Son ..... B01F 23/20
2017/0122586 A1 * 5/2017 Son ..... F24F 6/06
2017/0122587 A1 * 5/2017 Son ..... B01F 23/2132
2017/0122588 A1 * 5/2017 Lee ..... F24F 13/28
2017/0122589 A1 * 5/2017 Kim ..... F24F 6/04
2017/0122590 A1 * 5/2017 Son ..... B01F 23/21311
2017/0122591 A1 * 5/2017 Choi ..... F24F 6/16
2017/0122593 A1 * 5/2017 Son ..... B01D 46/10
2017/0122594 A1 * 5/2017 Lee ..... F24F 6/04
2017/0122595 A1 * 5/2017 Lee ..... F24F 8/10
2017/0122596 A1 * 5/2017 Lee ..... F24F 11/30
2017/0122598 A1 * 5/2017 Son ..... B01F 23/21
2017/0122599 A1 * 5/2017 Son ..... F24F 8/10
2017/0122600 A1 * 5/2017 Son ..... B01F 23/21
2017/0122601 A1 * 5/2017 Lee ..... F24F 13/20
2017/0122602 A1 * 5/2017 Son ..... F24F 6/04
2017/0122603 A1 * 5/2017 Kim ..... B01D 46/10
2017/0122605 A1 * 5/2017 Lee ..... F24F 6/16
2017/0122606 A1 * 5/2017 Son ..... G01F 23/0007
2018/0073663 A1 * 3/2018 Liu ..... G01F 23/808
2018/0283712 A1 * 10/2018 French ..... F04D 29/705
2018/0339258 A1 * 11/2018 Jeon ..... B05B 3/082
2019/0041075 A1 * 2/2019 Sarkar ..... F24F 11/62
2019/0041084 A1 * 2/2019 Atkins, Jr. ..... F24F 6/14
2019/0041086 A1 * 2/2019 Atkins, Jr. ..... F24F 6/14
2019/0063768 A1 * 2/2019 Chen ..... F24F 11/88
2019/0078797 A1 * 3/2019 Lee ..... F24F 6/04
2020/0263885 A1 * 8/2020 Baillie ..... F24F 6/16
2021/0172627 A1 * 6/2021 Jung ..... F24F 6/14
2021/0190342 A1 * 6/2021 Zhan ..... F24F 6/12

* cited by examiner

HUMIDIFIER

CROSS-REFERENCE TO RELATED APPLICATION

The present application is based on, and claims priority from, Chinese application number CN202122663762.8, filed Nov. 2, 2021, the disclosure of which is hereby incorporated by reference herein in its entirety.

TECHNICAL FIELD

The embodiments of the present disclosure relate to the technical field of humidifiers, and in particular, to a humidifier.

BACKGROUND ART

The humidifier usually comprises a water tank, which by treating the water in the water tank accordingly, in turn generates moist air and discharges it outdoors. The existing humidifier usually comprises an independent water filling pipe connected with the water tank and a moist air discharge channel. The above structure often complicates the internal structure of the humidifier, and increases the manufacturing difficulty and manufacturing cost.

The relevant humidifier with a channel shared by water and air will cause the fan discharging moist air to be drenched with water during the process of adding water, and may result in a malfunction of the fan.

Accordingly, a novel humidifier is needed in this field to solve the above problem.

SUMMARY OF THE UTILITY MODEL

The content of the present disclosure is to introduce concepts in a brief form, and these concepts will be described in detail in the following section of the detailed description of the utility model. The content of the present disclosure is not intended to identify the key features or essential features of the claimed technical solution, nor is it intended to limit the scope of the claimed technical solution.

Some embodiments of the present disclosure propose a humidifier to solve the technical problem mentioned in the background art section above.

The humidifier comprises a housing and an inclined flow fan assembly fixed in the housing through a connecting plate, wherein the inclined flow fan assembly comprises a fan motor fixedly connected with the connecting plate and a fan hub connected with the drive shaft of the fan motor, the inside of the fan hub is further provided with a first annular water retaining portion, the bottom end of the first annular water retaining portion is connected with the fan hub; the inclined flow fan assembly further comprises a second annular water retaining portion arranged between the fan hub and the first annular water retaining portion and fixedly connected with the connecting plate, the bottom end of the second annular water retaining portion is lower than the top ends of the fan hub and the first annular water retaining portion, and in the working state, the chamber formed by the second annular water retaining portion and the fan motor is filled with air.

Alternatively, the fan hub and the first annular water retaining portion form a water collecting chamber, and a plurality of drainage holes are uniformly arranged at the bottom of the water collecting chamber.

Alternatively, the humidifier further comprises a plurality of inclined flow gratings and a water distributing plate, the plurality of inclined flow gratings are arranged around the circumference of the water distributing plate, wherein each of the inclined flow gratings is tilted around its own transverse axis direction; the above fan assembly comprises a plurality of fan blades connected along the circumference of the fan hub, and each of the fan blades is tilted around its own transverse axis direction; the tilt direction of the inclined flow gratings is different from that of the fan blades.

Alternatively, the acute angles between the inclined flow gratings and the horizontal plane, as well as between the fan blades and the horizontal plane, are set at 40°-60°.

Alternatively, the humidifier further comprises a humidifying net and an infiltration assembly arranged at the lower end of the fan hub, the infiltration assembly comprises an annular water distributing groove and a plurality of support rods, one of the support rods is hollow, with both ends respectively connected with the annular water distributing groove and the water tank arranged at the bottom of the housing, and the humidifying net is arranged around the annular water distributing groove.

Alternatively, the top of the humidifying net is further connected with a reinforcing belt, which is connected to the housing and passes through the humidifying net.

Alternatively, the annular water distributing groove comprises an annular groove and a plurality of seepage outlets arranged on the side wall of the annular groove, the annular groove is connected with one of the above support rods.

Alternatively, the annular water distributing groove further comprises a cover plate detachably arranged to the annular groove, an annular stop is arranged at the bottom of the cover plate, and in the assembled state, the stop is closely engaged with the inner wall of the annular groove.

Alternatively, a water pump is arranged in the accommodation chamber of the water tank, the accommodation chamber is made of a flexible damping package, and in the assembled state, the flexible damping package envelops the water pump.

The above embodiments of the present disclosure have the following beneficial effects that: through the humidifier of some embodiments of the present disclosure, water can be prevented from entering the fan motor, thereby improving the reliability and safety of the humidifier. To be specific, the reason why the fan motor of the relevant humidifier is prone to failure when caught in water is that: the fan hub rotates under the drive of the fan motor, so there is a gap between the fan hub and the connector fixing the fan motor. During the process of adding water, water will enter the fan hub and fan motor through the gap.

On this basis, the humidifier of some embodiments of the present disclosure comprises not only a fan motor and a fan hub, but also a first annular water retaining portion and a second annular water retaining portion. To be specific, the first annular water retaining portion is connected with the inner bottom end of the fan hub. When water enters the inside of the fan hub from the gap between the fan hub and the connecting plate, it will accumulate between the fan hub and the first annular water retaining portion. The first annular water retaining portion can block the water from the fan motor and prevent it from entering the fan motor.

Further, the humidifier of some embodiments of the present disclosure further comprises a second annular water retaining portion, the second annular water retaining portion is arranged between the fan hub and the first water retaining portion, the top end is fixed to the bottom of the connecting plate, and the second annular water retaining portion is buckled above the fan motor. Then, an inverted chamber can be formed between the second annular water retaining portion and the first water retaining plate. In the working state, when the level of water accumulated between the fan hub and the first annular water retaining portion increases gradually and reaches the bottom end of the second annular water retaining portion, the air in the chamber will converge into the chamber. Because the accumulated water has a fairly low water pressure, it is not enough to compress the air in the chamber, so that the accumulated water will not cross the upper end of the first annular water retaining portion. This prevents water from entering the fan motor, thereby improving the reliability and water-resisting property of the humidifier.

BRIEF DESCRIPTION OF THE DRAWINGS

The above and other features, advantages, and aspects of the embodiments of the present disclosure will become more apparent in conjunction with the accompanying drawings and with reference to the following specific implementations. Throughout the drawings, the same or similar reference signs indicate the same or similar elements. It should be understood that the drawings are schematic, and the components and elements are not necessarily drawn to scale.

DETAILED DESCRIPTION OF THE UTILITY MODEL

Figure 1:
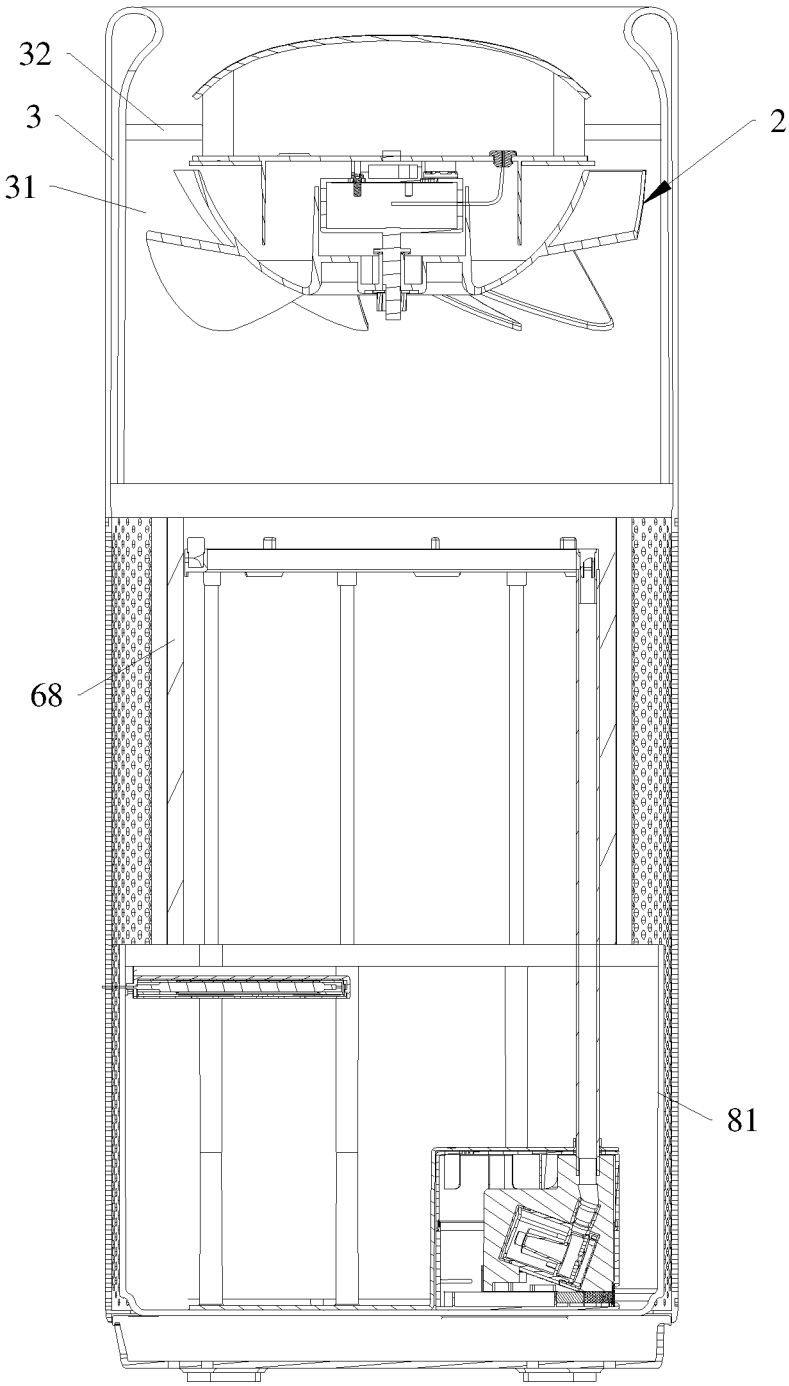
FIG. 1 is a cutaway view of some embodiments of the humidifier according to the present disclosure.

Hereinafter, the embodiments of the present disclosure will be described in more detail with reference to the accompanying drawings. Although certain embodiments of the present disclosure are shown in the drawings, it should be understood that the present disclosure can be implemented in various forms, and shall not be construed as being limited to the embodiments set forth herein. On the contrary, these embodiments are provided for a more thorough and complete understanding of the present disclosure. It should be understood that the drawings and embodiments of the present disclosure are used only for illustrative purposes, not to limit the protection scope of the present disclosure.

Besides, it should be noted that, for ease of description, only the portions related to the relevant utility model are shown in the drawings. In the case of no confliction, the embodiments in the present disclosure and the features in the embodiments can be combined with each other.

It should be noted that such concepts as "first" and "second" mentioned in the present disclosure are only used to distinguish different devices, modules or units, not to limit the order of functions performed by these devices, modules or units, or the interdependence therebetween.

It should be noted that such adjuncts as "one" and "more" mentioned in the present disclosure are illustrative, not restrictive, and those skilled in the art should understand that, unless the context clearly indicates otherwise, they should be understood as "one or more".

The names of messages or information exchanged between multiple devices in the embodiments of the present disclosure are only used for illustrative purposes, not for limiting the scope of these messages or information.

Hereinafter, the present disclosure will be described in detail with reference to the drawings and in conjunction with the embodiments.

First, see FIG. 1, which is a cutaway view of some embodiments of the humidifier according to the present disclosure. As shown in FIG. 1, the humidifier may comprise a housing 3, an inclined flow fan assembly 2, an infiltration assembly (not wholly shown in the figure), a humidifying net 68 and a water tank 81. The inclined flow fan assembly 2 can be connected with the housing 3 through a retainer plate 32. A channel 31 for adding water and discharging air can be formed between the inclined flow fan assembly 2 and the housing 3. During the process of adding water, the water enters from the top of the housing 3 to the channel 31, and then sprinkles into the humidifying net 68 and the water tank 81. During the discharge of moist air, the infiltration assembly sprinkles water over the humidifying net 68. Under the suction of the inclined flow fan assembly 2, the air outside passes through the humidifying net 68 via the air inlet on the housing 3 to form moist air, and is finally discharged through the channel 31 from the top end of the housing 3.

The inclined flow fan assembly 2 can provide appropriate wind pressure and blowing rate. To be specific, a centrifugal fan throws out the air in a direction perpendicular to the air intake direction through centrifugal force, but there is the case that the blowing rate may be insufficient. For the humidifier, insufficient blowing rate will greatly reduce the humidification effect. Meanwhile, an axial flow fan has the problem of rather small wind pressure. Therefore, the humidifier of the present disclosure chooses an inclined flow fan assembly.

Besides, in order to improve the safety of the humidifier, the distance between the inclined flow fan assembly 2 and the top end of the housing 3 can be increased. Thus, the user may avoid injury if accidentally puts his or her fingers into the above channel 31 when the inclined flow fan assembly 2 is in the working state.

Figure 2:
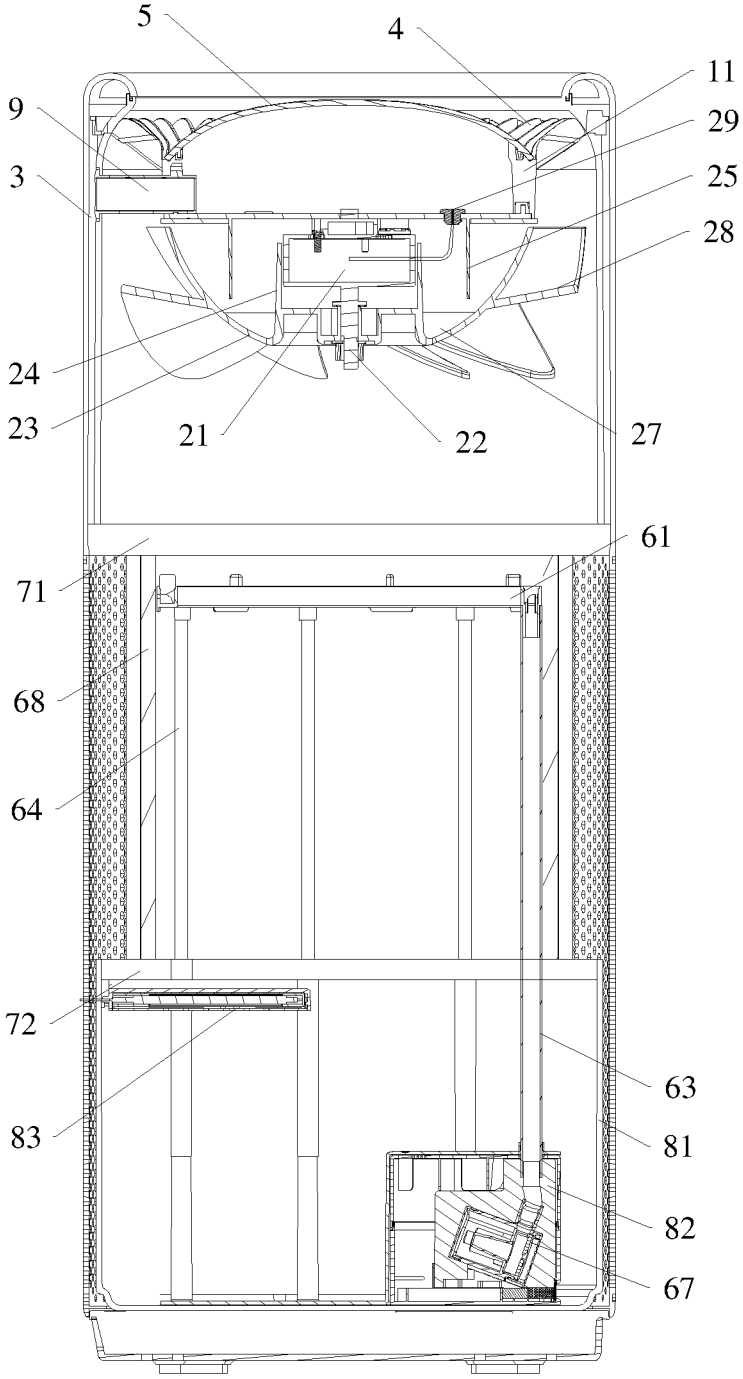
FIG. 2 is a cutaway view of other embodiments of the humidifier according to the present disclosure.
Figure 3:
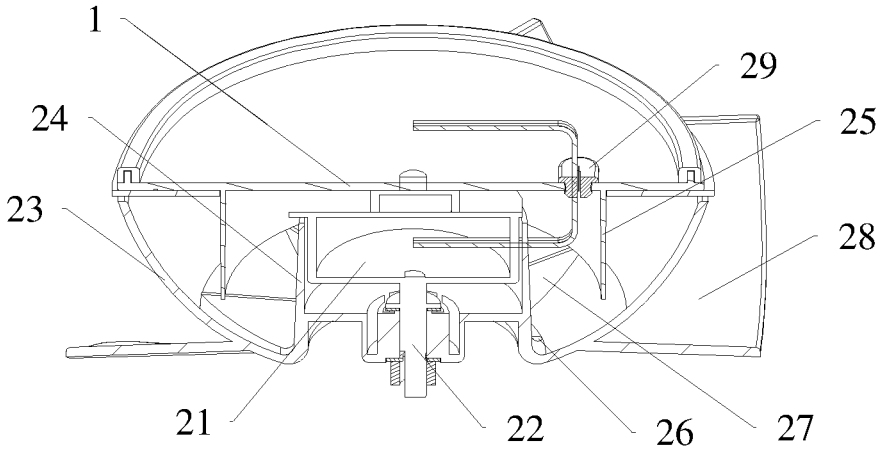
FIG. 3 is a cutaway view of some embodiments of the inclined flow fan assembly according to the present disclosure.

Next, the inclined flow fan assembly will be described in combination with FIG. 2 and FIG. 3. FIG. 2 is a cutaway view of other embodiments of the inclined flow fan assembly according to the present disclosure. FIG. 3 is a cutaway view of some embodiments of the inclined flow fan assembly according to the present disclosure. As shown in FIG. 2 and FIG. 3, the inclined flow fan assembly 2 comprises a fan motor 21, a fan hub 23 connected to the drive shaft 22 of the fan motor 21, and a first annular water retaining portion 24. The fan motor 21 is fixedly connected with a connecting plate 1. The connecting plate 1 is fixedly connected with the housing 3. The drive shaft 22 of the fan motor 21 is connected to the bottom of the fan hub 23. The upper end of the fan hub 23 is spaced from the connecting plate 1. A fan blade 28 is obliquely mounted to the outer surface of the fan hub 23. In the working state, the fan motor 21 can drive the fan hub 23 and the fan blade 28 to rotate.

In order to prevent water from entering the fan motor 21 from the gap between the top end of the fan hub 23 and the connecting plate 1 during the process of adding water, the bottom end of the first annular water retaining portion 24 is connected with the bottom end of the fan hub 23. The top end of the first annular water retaining portion 24 is close to the connecting plate 1, and the first annular water retaining portion 24 can surround the fan motor 21 to isolate the water. It should be noted that when the fan motor 21 adopts the form of an outer rotor, the upper end of the first water retaining portion 24 is engaged with the fan motor 21. When the fan motor 21 adopts the form of an inner rotor, the upper end of the first water retaining portion 24 is spaced from the fan motor 21, so as not to affect the rotation of the fan hub 23.

Further, the inclined flow fan assembly 2 may also comprise a second annular water retaining portion 25. The second annular water retaining portion 25 is arranged between the fan hub 23 and the first annular water retaining portion 24. The upper end of the second annular water retaining portion 25 is fixedly connected with the connecting plate 1. Wherein, the bottom end of the second annular water retaining portion 25 is lower than the top ends and the fan hub 23 of the first annular water retaining portion 24. The second annular water retaining portion 25 is buckled above the fan motor 21. Further, the space between the second annular water retaining portion 25 and the first annular water retaining portion 24 can form an inverted chamber. In the working state, the chamber is filled with gas. When the level of water accumulated between the fan hub 23 and the first annular water retaining portion 24 gradually increases to the bottom end of the second annular water retaining portion 25, the air in the chamber will converge into the chamber. Because the accumulated water has a fairly low water pressure, it is not enough to compress the air in the chamber, so that the accumulated water will not cross the upper end of the first annular water retaining portion 24. This prevents water from entering the fan motor 21, thereby improving the reliability and water-resisting property of the humidifier.

Since the fan motor 21 needs to be connected with a wire, an opening can be set on the connecting plate 1 to thread the wire to the fan motor 21. At the same time, silica gel, rubber and other seals 29 are arranged at the opening to ensure the tightness of the chamber.

Continue to see FIG. 3, the water collecting chamber formed by the fan hub 23 and the first annular water retaining portion 24 can store water. A plurality of drainage holes 26 can be uniformly arranged at the bottom of the water collecting chamber. In this way, the water in the water collecting chamber can flow into the water tank 81 through the drainage holes 26. Alternatively, the water collecting chamber may also comprise a plurality of division plates 27, each of which separates the adjacent drainage holes 26. The upper ends of the division plates 27 may be lower than the lower end of the second annular water retaining portion 25. The division plates 27 are used to improve the strength of the fan hub.

Figure 4:
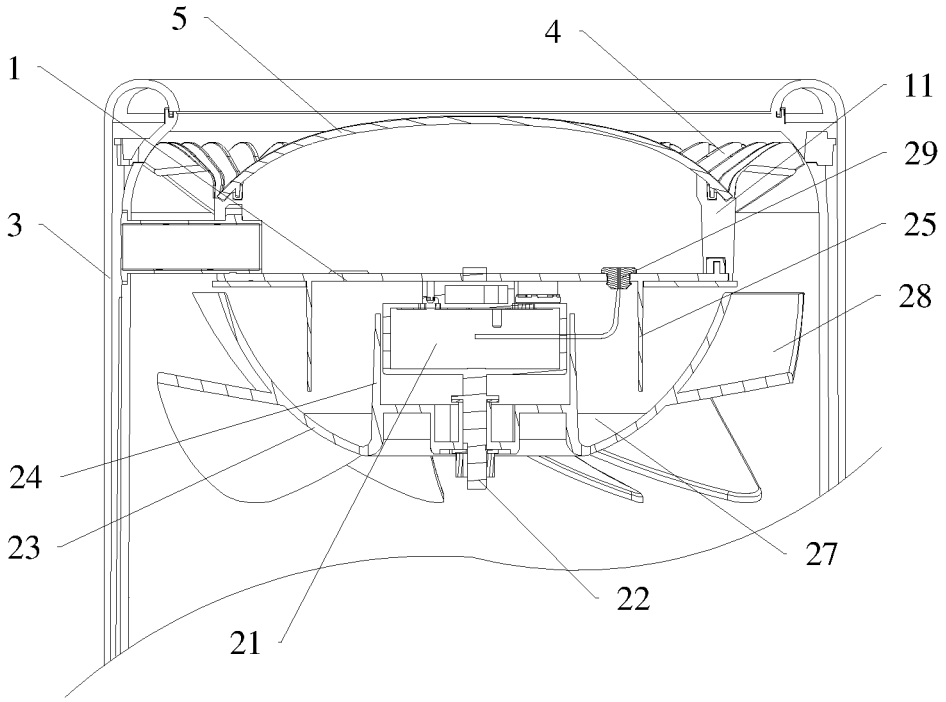
FIG. 4 is a cutaway view of other embodiments of the inclined flow fan assembly according to the present disclosure.

Next, see FIG. 4 and continue to see FIG. 2. FIG. 4 is a cutaway view of other embodiments of the inclined flow fan assembly according to the present disclosure. As shown in FIG. 4, the humidifier may further comprise a water distributing plate 5 and an inclined flow grating 4, and the inclined flow grating 4 plays a role in improving the safety of the humidifier, preventing the user's fingers from entering the inside of housing 3 that may result in accidental injury. The inclined flow grating 4 connects the top of the housing 3 and an annular connector 11. The annular connector 11 is connected with the upper end of the connecting plate 1. The water distributing plate 5 is arranged above the annular connector 11. The water distributing plate 5 is arranged in an arc shape and buckled above the inclined flow fan assembly 2, so that in the process of adding water, the water fluid spreads from the arc top to the periphery, and can flow down from both sides of the inclined flow fan assembly 2, thereby further preventing the water from entering the fan motor 21.

A circuit board or the like can be placed in the chamber between the water distributing plate 5 and the connecting plate 1. The wire connected to the water pump 67 or other electrical components in the circuit board can be wrapped by a waterproof pipe 9 (shown in FIG. 2), thereby preventing water from entering the circuit board and causing a short during the process of adding water.

Alternatively, the above plurality of inclined flow gratings 4 may be arranged longitudinally at uniform intervals.

Continue to see FIG. 2 and FIG. 4, furthermore, in order to make the moist air smoothly pass through the inclined flow gratings 4, reduce the wind resistance and increase the discharge range of the moist air, each of the above inclined flow gratings 4 can further be tilted around its own transverse axis direction. Thus, the acting face of the inclined flow gratings 4 forms an included angle with the horizontal plane. The transverse axis may be an axis passing through the centers of the left and right ends of the inclined flow gratings 4.

The fan blade 28 can be obliquely connected to the fan hub 23 around its own transverse axis direction. Meanwhile, the tilt direction of the fan blade 28 is opposite to that of the inclined flow grating 4. The transverse axis direction may be an axial line passing through the centers of the left and right ends of the fan blade 28. The advantage of this setting is that it can discharge the moist air smoothly, reduce the wind resistance and lower the noise. Specifically, as shown in FIGS. 2 and 4, the fan blade 28 is tilted to the left around its own transverse axis direction. When viewed from the top of the humidifier, the fan blade 28 rotates clockwise so that the moist air moves upward. At this time, the generated oblique moist air will pass through the inclined flow gratings 4. Since the inclined flow gratings 4 is tilted to the right around their transverse axis directions, the inclined flow gratings 4 are arranged clockwise, thereby being adapted to the exhaust direction. In this way, the moist air can smoothly pass through the gap between the inclined flow gratings 4, so that the acting face of the inclined flow gratings 4 has less resistance against the moist air, thereby reducing wind resistance and noise. After repeated attempts and experiments, the fan blade 28 is tilted around its own transverse axis direction, and the acute angle with the horizontal plane can be set at 40°-60°. At the same time, the acute angle of the above inclined flow grating around its own transverse axis direction is also set at 40°-60°. To be specific, within this angle range, a smooth discharge of moist air can be guaranteed. When the above angle is too small or too large, the gap between the inclined flow gratings becomes smaller, which will also produce resistance against the discharge of moist air.

It should be noted that the fan blade 28 can also tilt to the right around its own transverse axis direction. In the working state, when viewed from the top of the humidifier, the fan blade rotates counterclockwise to make the moist air move upward. At the same time, the inclined flow grating tilts to the left around its own transverse axis direction. Those skilled in the art can choose according to the actual situation, but such change does not go beyond the protection scope of the present disclosure.

In this way, the inclined flow fan assembly 2 of the present disclosure, on the premise of a guaranteed blowing rate, and when passing through the tilted inclined flow gratings 4, can smoothly discharge the moist air, reduce the wind resistance and lower the noise. In addition, the moist air is discharged at a certain angle, which can make the moist air discharge outside the humidifier in a divergent manner, thereby enhancing the humidification range of the humidifier. At the same time, the tilt direction of the fan blade 28 and the inclined flow gratings 4 can be adjusted according to the actual situation, so that the discharge direction of the moist air can be clockwise or counterclockwise.

Figure 5:
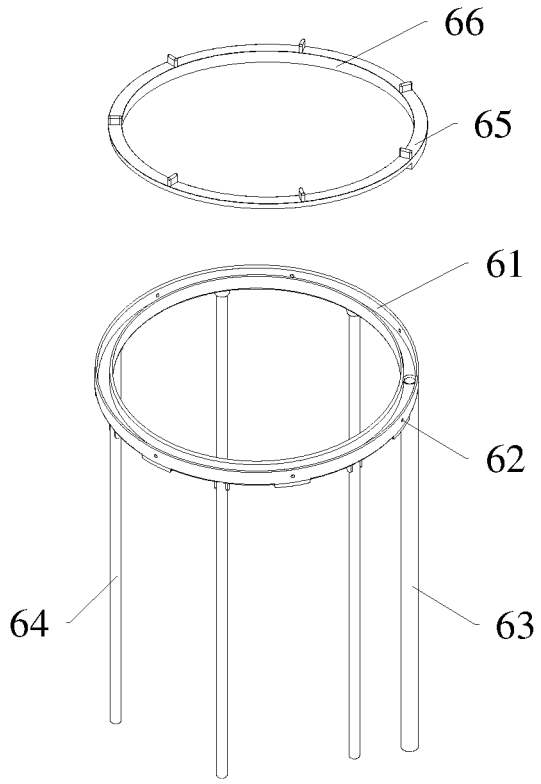
FIG. 5 is a structural diagram of some embodiments of the annular water distributing groove according to the present disclosure.

Finally, see FIG. 5 and continue to see FIG. 2. FIG. 5 is a structural diagram of some embodiments of the annular water distributing groove according to the present disclosure. As shown in FIG. 1 and FIG. 4, the above infiltration assembly comprises an annular water distributing groove (not wholly shown in the figure) and a plurality of support rods 63 and 64. One support rod 63 of the plurality of support rods 63 and 64 is hollow, with both ends connected with a water tank 81 and the annular water distributing groove respectively. The above humidifying net 68 is arranged around the annular water distributing groove. Further, the annular water distributing groove comprises an annular groove 61 and a plurality of seepage outlets 62 arranged on the side wall of the annular groove 61, and the annular groove 61 is connected with the above hollow support rod 63. In the working state, the water in the water tank 81 enters the annular groove 61 through the hollow support rod 63, then flows out from a plurality of seepage outlets 62, and sprinkles on the humidifying net 68, which makes the humidifying net 68 more fully infiltrated and improves the humidification effect. Alternatively, the water in the water tank can be transmitted to the hollow support rod 63 by the water pump 67 arranged in the water tank 81. Further, the annular water distributing groove may also comprise a removable cover plate 65. The bottom of the cover plate 65 is provided with an annular stop 66. In the assembled state, the annular stop 66 is closely engaged with the inner wall of the annular groove 61, thereby facilitating the removal of the cover plate 65, and thereby cleaning the water distributing groove 61. Alternatively, the cover plate 65 and the annular stop 66 may be made of silica gel or rubber material.

Further, in order to avoid deformation of the humidifying net 68 due to excessive moisture absorption, a reinforcing belt (not shown in the figure) can be connected at the top of the humidifying net 68, and the reinforcing belt is connected to the housing 3 and passes through the humidifying net 68, thereby maintaining the shape of the humidifying net 68.

Alternatively, the water pump 67 is placed in the accommodation chamber of the water tank 81. The accommodation chamber is made of a flexible damping package 82. In the assembled state, the flexible damping package 82 envelops the water pump 67. The package can be made of soft silica gel or rubber material with elastic properties. In addition, an ultraviolet germicidal lamp 83 can be provided on the top of the water tank 81 to sterilize the water in the water tank 81.

The humidifier of some embodiments of the present disclosure comprises a water distributing plate, a first annular water retaining portion and a second annular water retaining portion, being able to prevent water from entering the fan motor from three stages. Firstly, in the stage of adding water, due to the arc shape setting of the water distributing plate, water can spread from the arc top to the periphery and flow down from both sides of the inclined flow fan assembly. When some water enters the inside of the fan hub, the first annular water retaining portion can isolate the water from the fan motor. When more water enters the water collecting chamber, because the second annular water retaining portion can form an inverted chamber, in the working state, the chamber is filled with gas, and the air in the chamber will converge into the chamber. Because the accumulated water has a fairly low water pressure, it is not enough to compress the air in the chamber, so that the accumulated water will not cross the upper end of the first annular water retaining portion 24. In this way, water can be prevented from entering the fan motor in three different stages, thus effectively improving the safety of the fan motor and avoiding short circuits and so on.

Besides, in order to enable the moist air to be smoothly discharged from the inclined flow gratings, the fan blades of the inclined flow fan assembly can be tilted around their own transverse axis direction, and the inclined flow gratings are tilted around their own axis direction. In this way, on the premise of a guaranteed blowing rate, the discharged moist air is discharged at a certain angle. When passing through the tilted inclined flow gratings, the moist air can be discharged smoothly, the wind resistance is reduced and the noise is lowered. In addition, the moist air being discharged at a certain angle can make the moist air discharge outside the humidifier in a divergent manner, thereby enhancing the humidification range of the humidifier.

The above description is only some preferred embodiments of the present disclosure and an explanation of the applied technical principles. Those skilled in the art should understand that the scope of invention involved in the embodiments of the present disclosure is not limited to the technical solutions formed by the specific combination of the above technical features, but should also cover other technical solutions formed by any combination of the above technical features or their equivalent features in the case of not departing from the above-mentioned inventive concept, for example, technical solutions formed by replacing the above features with the technical features of similar functions disclosed in (but not limited to) the embodiments of the present disclosure.

What is claimed is:

1. A humidifier, comprising a housing, characterized in further comprising an inclined flow fan assembly fixed in the housing through a connecting plate, the inclined flow fan assembly as a whole being arranged underneath the connecting plate and a common channel for adding water and discharging air being formed between the inclined flow fan assembly and the housing, wherein, the inclined flow fan assembly comprises a fan motor fixedly connected with a lower surface of the connecting plate and a fan hub connected with a drive shaft of the fan motor, an upper end of the fan hub being spaced from the lower surface of the connecting plate, wherein the inside of the fan hub is further provided with a first annular water retaining portion, a bottom end of the first annular water retaining portion is connected with a bottom end of the fan hub, and the first annular water retaining portion surrounds the fan motor;

the inclined flow fan assembly further comprises a second annular water retaining portion arranged between the fan hub and the first annular water retaining portion and fixedly connected with the lower surface of the connecting plate, wherein a bottom end of the second annular water retaining portion is lower than top ends of the fan hub and the first annular water retaining portion, the second annular water retaining portion is hung above the fan motor such that a chamber is formed between the second annular water retaining portion and the first annular water retaining portion, and in the working state, the chamber is filled with air.

2. The humidifier of claim 1, characterized in that, the fan hub and the first annular water retaining portion form a water collecting chamber for collecting water, and a plurality of drainage holes for discharging the water are uniformly arranged at a bottom of the water collecting chamber.

3. The humidifier of claim 1, characterized in that, the humidifier further comprises a plurality of inclined flow gratings and a water distributing plate, wherein the plurality of inclined flow gratings are arranged around a circumference of the water distributing plate, and wherein each of the inclined flow gratings is tilted around its own transverse axis direction; the above fan assembly comprises a plurality of fan blades connected along a circumference of the fan hub, and each of the fan blades is tilted around its own transverse axis direction; the tilt direction of the inclined flow gratings is different from that of the fan blades.

4. The humidifier of claim 3, characterized in that, acute angles between the inclined flow gratings and a horizontal plane, as well as between the fan blades and the horizontal plane, are set at 40°-60°.

5. The humidifier of claim 1, characterized in that, the humidifier further comprises a humidifying net and an infiltration assembly arranged at a lower end of the fan hub, the infiltration assembly comprises an annular water distributing groove and a plurality of support rods, one of the support rods is hollow, with both ends of the hollow support rod respectively connected with the annular water distributing groove and a water tank arranged at a bottom of the housing, and the humidifying net is arranged around the annular water distributing groove.

6. The humidifier of claim 5, characterized in that, a top of the humidifying net is further connected with a reinforcing belt, which is connected to the housing and passes through the humidifying net.

7. The humidifier of claim 6, characterized in that, the annular water distributing groove comprises an annular groove and a plurality of seepage outlets arranged on a side wall of the annular groove, the annular groove is connected with one of the support rods.

8. The humidifier of claim 7, characterized in that, the annular water distributing groove further comprises a cover plate detachably arranged to the annular groove, an annular stop is arranged at a bottom of the cover plate, and in an assembled state, the stop is closely engaged with an inner wall of the annular groove.

9. The humidifier of claim 8, characterized in that, a water pump is arranged in an accommodation chamber of the water tank, the accommodation chamber is made of a flexible damping package, and in the assembled state, the flexible damping package envelops the water pump.

* * * * *